US012589320B2

(12) United States Patent
Wellejus et al.

(10) Patent No.: US 12,589,320 B2
(45) Date of Patent: Mar. 31, 2026

(54) TOY FIGURINE WITH A BUTTON SYSTEM

(71) Applicant: LEGO A/S, Billund (DK)

(72) Inventors: René Christensen Wellejus, Billund (DK); Troels Nobert, Billund (DK); Henning Kirk, Billund (DK)

(73) Assignee: LEGO A/S, Billund (DK)

( * ) Notice: Subject to any disclaimer, the term of this patent is extended or adjusted under 35 U.S.C. 154(b) by 112 days.

(21) Appl. No.: 17/798,251

(22) PCT Filed: Mar. 10, 2021

(86) PCT No.: PCT/EP2021/056052
§ 371 (c)(1),
(2) Date: Aug. 8, 2022

(87) PCT Pub. No.: WO2021/180789
PCT Pub. Date: Sep. 16, 2021

(65) Prior Publication Data

US 2023/0075484 A1 Mar. 9, 2023

(30) Foreign Application Priority Data

Mar. 10, 2020 (DK) ..... PA 2020 70158

(51) Int. Cl.
*A63H 33/26* (2006.01)
*A63H 3/00* (2006.01)
*A63H 3/28* (2006.01)

(52) U.S. Cl.
CPC ..... *A63H 3/006* (2013.01); *A63H 3/28* (2013.01); *A63H 33/26* (2013.01); *A63H 2200/00* (2013.01)

(58) Field of Classification Search
CPC ..... A63H 3/00–52
See application file for complete search history.

(56) References Cited

U.S. PATENT DOCUMENTS 3,531,890 A * 10/1970 Manning ..... A63H 13/10 335/90
3,599,364 A * 8/1971 Garcia ..... A63H 13/12 446/355

(Continued)

FOREIGN PATENT DOCUMENTS

CN 2887391 Y 4/2007
CN 1960787 A 5/2007

(Continued)

OTHER PUBLICATIONS

CN Office Action corresponding to U.S. Appl. No. 17/798,251, dated Sep. 19, 2023, 9 pages (GB Translation).

(Continued)

*Primary Examiner* — Nicholas J. Weiss
*Assistant Examiner* — Matthew B Stanczak
(74) *Attorney, Agent, or Firm* — Day Pitney LLP; Anthony A. Kassas; Emily Ferriter Russo

(57) ABSTRACT

A toy figurine comprising a multi-part housing. The toy figurine includes a circuit board provided in the multi-part housing. The circuit board is in electrical communication with an electrical switch for activating a functionality of the circuit board. The toy figurine includes an elongate pin provided in an interior of the multi-part housing and a push button provided on an exterior of the multi-part housing and adjacent to the elongate pin. Upon actuation of the push button by a user, the push button drives the elongate pin to contact the electrical switch.

19 Claims, 9 Drawing Sheets

(56) References Cited

U.S. PATENT DOCUMENTS 3,949,517 A * 4/1976 Reiner ..... A63H 17/22 446/485
3,950,627 A * 4/1976 Murata ..... H01H 13/7006 200/530
4,069,613 A * 1/1978 Lemelson ..... A63H 7/00 446/365
D248,178 S * 6/1978 Tapdrup ..... D21/623
4,135,326 A * 1/1979 Tong ..... A63H 13/12 446/158
4,246,827 A 1/1981 Gazzola
4,249,338 A * 2/1981 Wexler ..... A63H 3/24 446/303
4,319,751 A * 3/1982 Kurushima ..... A63H 13/06 446/4
4,348,191 A 9/1982 Lipsitz et al.
4,355,483 A * 10/1982 Korzelius ..... A63H 29/22 200/292
4,526,552 A * 7/1985 Rhodes ..... A63H 3/20 446/338
4,547,171 A * 10/1985 Horimoto ..... A63H 3/006 446/72
D283,150 S * 3/1986 Jensen ..... D21/635
4,587,738 A * 5/1986 Kang ..... G01B 3/1005 33/502
4,588,387 A * 5/1986 Swenson ..... G10K 3/00 362/802
D284,091 S * 6/1986 Arnau ..... D21/577
4,680,019 A * 7/1987 Baerenwald ..... A63H 3/46 446/378
4,701,146 A * 10/1987 Swenson ..... A63H 5/00 362/802
4,718,876 A * 1/1988 Lee ..... A63H 3/001 601/78
4,729,564 A * 3/1988 Kuna ..... A63F 9/183 463/31
4,741,717 A * 5/1988 Wolf ..... A63H 3/48 446/485
4,846,750 A * 7/1989 Tapdrup ..... A63H 33/086 446/128
5,092,810 A * 3/1992 Kwan ..... A63H 5/04 446/268
5,118,319 A * 6/1992 Smith ..... A63H 33/22 446/268
D329,068 S * 9/1992 Rasmussen ..... D21/659
5,221,225 A * 6/1993 Newbold ..... A63H 5/00 446/485
D337,355 S * 7/1993 Voldmester ..... D21/659
D337,356 S * 7/1993 Voldmester ..... D21/659
5,314,336 A * 5/1994 Diamond ..... G09B 5/062 250/221
D349,538 S * 8/1994 Pedersen ..... D21/615
D362,876 S * 10/1995 Pedersen ..... D21/601
5,536,054 A * 7/1996 Liaw ..... A23G 3/50 446/236
5,536,196 A * 7/1996 Sternberg ..... A63H 5/00 206/217
RE35,375 E * 11/1996 Park ..... A63H 18/007 446/353
5,651,716 A * 7/1997 Mowrer ..... A63H 3/28 446/297
D387,101 S * 12/1997 Nielsen ..... D21/615
5,730,638 A * 3/1998 Ward ..... A63H 3/006 362/108
D394,466 S * 5/1998 Pedersen ..... D21/493
5,990,430 A * 11/1999 Shiau ..... F21L 4/005 200/60
D423,295 S * 4/2000 Buck ..... D7/606
6,089,952 A * 7/2000 Dowd ..... A63H 19/10 446/463
6,129,606 A * 10/2000 Yuen ..... A63H 15/04 446/351
6,200,186 B1 * 3/2001 Coleman ..... A23G 3/563 446/73
6,227,931 B1 * 5/2001 Shackelford ..... G09B 5/02 446/268
6,253,950 B1 * 7/2001 Buck ..... B65D 81/3816 220/592.15
6,425,796 B1 * 7/2002 Gaynor ..... A63H 3/46 446/376
6,438,760 B1 * 8/2002 Wakefield ..... A42B 1/004 99/421 A
6,443,796 B1 9/2002 Shackelford
6,513,947 B1 * 2/2003 Huang ..... F21V 23/0421 362/208
D846,433 S * 4/2019 Charria ..... D11/160
D887,893 S * 6/2020 Beauregard ..... D11/160
12,447,415 B2 * 10/2025 Wellejus ..... A63H 3/28
2005/0170740 A1 * 8/2005 Kleinman ..... A63H 3/28 446/97
2007/0037474 A1 * 2/2007 Lee ..... A63H 3/02 446/297
2007/0072513 A1 * 3/2007 Rothmiller ..... A63H 3/46 446/369
2008/0087684 A1 * 4/2008 Koshimoto ..... F41H 5/08 89/36.01
2009/0215357 A1 * 8/2009 Seligman ..... A63H 33/042 446/127
2012/0190270 A1 * 7/2012 Chan ..... A63H 3/46 446/268
2013/0040531 A1 * 2/2013 Ferron ..... A63H 3/46 446/85
2015/0314210 A1 * 11/2015 Lama ..... A63H 33/062 446/128
2018/0117479 A1 * 5/2018 Coolidge ..... G09B 5/00
2018/0311590 A1 * 11/2018 Rasmussen ..... G02B 6/0005
2019/0038987 A1 * 2/2019 Smith ..... A63H 33/08
2019/0201796 A1 * 7/2019 Seymour ..... A63H 3/28
2019/0262730 A1 * 8/2019 Ly ..... A63H 3/46
2019/0336879 A1 * 11/2019 Gaines ..... A63H 33/001
2021/0176561 A1 * 6/2021 Li ..... H04R 27/00
2023/0067137 A1 * 3/2023 Wellejus ..... A63H 3/365
2023/0075484 A1 * 3/2023 Wellejus ..... A63H 3/28
2023/0088274 A1 * 3/2023 Kirk ..... H01M 50/514
2023/0338865 A1 * 10/2023 Schou ..... A63H 3/28

FOREIGN PATENT DOCUMENTS

CN 201139954 Y 10/2008
CN 101972546 A 2/2011
CN 202822800 U 3/2013
CN 203799186 U 8/2014
CN 106370051 A 2/2017
CN 206163562 U 5/2017
CN 207237278 U 4/2018
CN 107982940 A 5/2018
CN 207785908 U 8/2018
CN 207980413 U 10/2018
CN 108796803 A 11/2018
CN 208975151 U 6/2019
CN 113365709 A 9/2021
EP 0903793 A1 3/1999
WO 9939794 A1 8/1999

OTHER PUBLICATIONS

International Search Report and Written Opinion in corresponding to International Application No. PCT/EP2021/056052, dated Jun. 8, 2021, 8 pages.
DK Search Report in Application No. PA 2020 70158, dated Jan. 2019, 4 pages, English translation only.

* cited by examiner

TOY FIGURINE WITH A BUTTON SYSTEM

CROSS-REFERENCE TO RELATED APPLICATIONS

The present application claims priority to Danish Patent Application No. PA 202070158 filed on Mar. 10, 2020, and is a U.S. national stage application under 35 U.S.C. § 371 of co-pending International Application No. PCT/EP2021/056052 filed on Mar. 10, 2021, the contents of each are incorporated by reference herein in their entirety for all purposes.

FIELD OF DISCLOSURE

The present disclosure relates to a toy figurine, and more particularly to a toy figurine with a button system.

BACKGROUND

Today, even toys for smaller children may be electronic devices. Such electronic toy devices may comprise a plurality of electrical components to provide an interaction between the toy and the child/user, such as sensors, cameras, electronic displays, microphones, electronic controllers, lights (e.g. led light or loudspeakers). The plurality of electronic components may take up a lot of space both inside and on the surfaces of the toy electronic device, and further need a power supply of replaceable consumer type standard electric batteries. Batteries may take up a lot of space in the electronic toy device. Particularly in connection with electronic toy devices, the external surfaces of the electronic device may be further equipped with coupling means for coupling the electronic toy device to other toy elements, such as toy building blocks. The surfaces may also need decorative features in order for the user to identify the electronic device as a toy object resembling an object in the real world. These factors sometimes makes it difficult to provide enough space on the external surfaces of the electronic device for necessary buttons, such as buttons for activation of the electronic device or for activating certain functionalities of the electronic device. There is thus a need for an electronic device with a button system that alleviates the problem of finding space for buttons or makes it possible to locate buttons on locations of the surfaces of an electronic device where it would be difficult or otherwise require complex solutions to place buttons.

SUMMARY

These and other objects are, in a first aspect of the disclosure, obtained by a toy figurine comprising a housing having a set of outer walls; an internal space formed within the housing; a circuit board provided in the internal space of the housing; and a battery compartment formed within the housing configured for receiving two or more elongate batteries, and provided adjacent to said internal space of the housing. Wherein the battery compartment comprises a first battery space and a second battery space configured for receiving each of the elongate batteries. The battery compartment further comprises a lid covering said first and second battery spaces and forming at least a part of an outer wall of the housing.

A first electrical switch is provided in the inner space of the housing across from said lid and electronically connected to said circuit board. A first push button is provided in the lid opposite the first electrical switch, wherein a first push pin, formed separately from the first push button, is slideably arranged in a first pin guide provided between the first battery space and the second battery space. The first push pin is elongate and comprises a first contact surface at an outer end, and a second contact surface at an inner end of the first push pin. The first contact surface of the first push pin abuts on an inner contact surface of the first push button, and the second contact surface of the first push pin abuts on the first electrical switch.

At least some of the set of outer walls are provided with ornaments. The ornaments are visible to a user of the toy figurine. In preferred embodiments all, but one outer wall of the housing of the toy figurine are provided with ornaments.

The lid may coincide with an outer wall of the housing of the toy figurine. The lid may also be formed flush with an outer wall of the housing of the toy figurine. In one embodiment, the lid is provided in an outer wall comprising an ornamentation or ornamentation structure. The ornamentation or ornamentation structure is visible to the user, and forms part of traits or characteristics allowing identification of the figurine as a recognizable character. In some further embodiments, the lid is provided with an ornamentation structure.

The push button comprises an external surface. The external surface of the push button has a surface area. The first push pin comprises a first contact surface. The first contact surface has a surface area. The surface in which the lid is formed has a surface area.

In an embodiment, the surface area of an external surface of the push button is at least twice as large as the area of first contact surface of the first push pin. In an embodiment, the surface area of an external surface of the push button is at least three times as large as the area of first contact surface of the first push pin. In an embodiment, the surface area of an external surface of the push button is at least 7% of the surface area of the surface in which the lid is formed. In an embodiment, the surface area of an external surface of the push button is at 7-25% of the surface area of the surface in which the lid is formed.

Thereby a toy figurine, which has electronic functions is obtained, where the activation of desired functionalities may be located in surfaces of the electronic device that has earlier not been possible, or where complex electronic connections would be necessary. Where the toy figurine may be very small, while still allowing the user to operate the push button. The push button may be an an/off button.

The first electrical switch is configured for activating a functionality of the electronic device, for example turning the device on and off.

In some embodiment, the battery compartment may be integrated in housing of the electronic device. In other embodiments the battery compartment may be a separate entity or unit, which is attachable to/detachable from the electronic device in such a way that the battery compartment forms at least one outer surface of the electronic device when the two are connected.

The first electrical switch is fixed relative to the housing of the toy figurine. In some embodiment it may be arranged on an inner surface of one or more of the walls of the housing. In other embodiments it may be arranged on an inner wall of the housing for example an inner separating wall of the housing. In yet other embodiments the electrical switch may be arranged on a flange or other support structure of the housing.

In an embodiment, the circuit board is provided in parallel with the lid of the battery compartment, and opposite to the lid relative to said internal spaces.

In a further embodiment, the first electrical switch is attached to the circuit board.

The lid of the battery compartment is detachable from the battery compartment and/or the housing. Thus, the lid of the battery compartment may function as a lid/hatch/cover for the battery compartment. In some embodiments, the lid may be hinged to the battery compartment or to the housing.

In a further embodiment, the first push button is formed in a flexible or soft material. For example the first push button may be formed integral with the lid of the battery compartment as a flexible portion thereof.

In other embodiments, the first push button may be provided through an opening in the lid, and the push button is formed with rim which is attachable to a rim of the opening. In some embodiments thereof, the first push button may be linearly translationally attached relative to the rim of the opening.

In some embodiments, the button may be formed in a soft/flexible material and the first push button comprises a button body having an upper contact surface formed on the external side thereof, and the inner contact surface on an internal side thereof, and has one central portion of a first thickness surrounded by a circumferential portion of a reduced thickness. Thereby, when the rim of the first push button is attached to the rim of the opening, the circumferential portion of the first push button allows the central portion to move relative to the rim of the opening.

In any case, in a further embodiment, the battery compartment may comprise a dividing wall separating the first battery space from the second battery space. Thus, the dividing wall extends in a longitudinal direction of the battery compartment. In a further embodiment hereof, the first pin guide is formed in the dividing wall.

In any case, in a further embodiment, the electronic device may additionally comprise: a second electrical switch that may be provided in the inner space of the housing across from said lid and electronically connected to said circuit board, a second push button provided in the lid opposite the second electrical switch, a second push pin, slideably arranged in a second pin guide, provided between the first battery space and the second battery space. The second push pin is elongate and comprises a first contact surface at an outer end and a second contact surface at an inner end of the second push pin. The first contact surface of the second push pin abuts on an inner contact surface of the second push button, and the second contact surface of the second push pin abuts on the second electrical switch.

Thus, the electronic device is provided two button systems. As a result, additional function of the electronic device may be activated. For example the first push button may be an "on button", and the second push button may be the "off button", or the first push button may be an "on/off button" and the second push button may activate/deactivate another specific function or feature.

In one embodiment, the first push button and second push button may separately be arranged in the lid of the battery compartment as defined above. However, alternatively, the first push button and the second push button are formed integrated as one push button unit. In one embodiment hereof, the push button unit may be formed in a resilient (or soft) material, and the first push button and the second push button are connected by a connection flange.

In a preferred embodiment, an indentation is formed in the connection flange.

In further embodiments, wherein the battery compartment comprises a dividing wall separating the first battery space from the second battery space, and wherein the first pin guide and the second pin guide are formed in the dividing wall, a button divider may extends from the dividing wall, and be configured for cooperating with the indention formed in the connection flange.

In any of the embodiments of the electronic device described above, the electronic device may be of a type where a volume of the battery compartment larger than 30% of a total volume of the housing.

In any of the embodiments of the electronic device described above, the electronic device may be of a type where a volume of the battery compartment is larger than 50% of a total volume of the housing.

In any of the embodiments of the toy figurine described above, the toy figurine may be a first part of a two part toy figurine.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the disclosure will be described in greater detail with reference to embodiments shown by the enclosed figures. It should be emphasized that the embodiments shown are used for example purposes only and should not be used to limit the scope of the disclosure.

as shown in FIG. 1, and illustrating a use of the toy figurine.

DETAILED DESCRIPTION

Figure 1A:
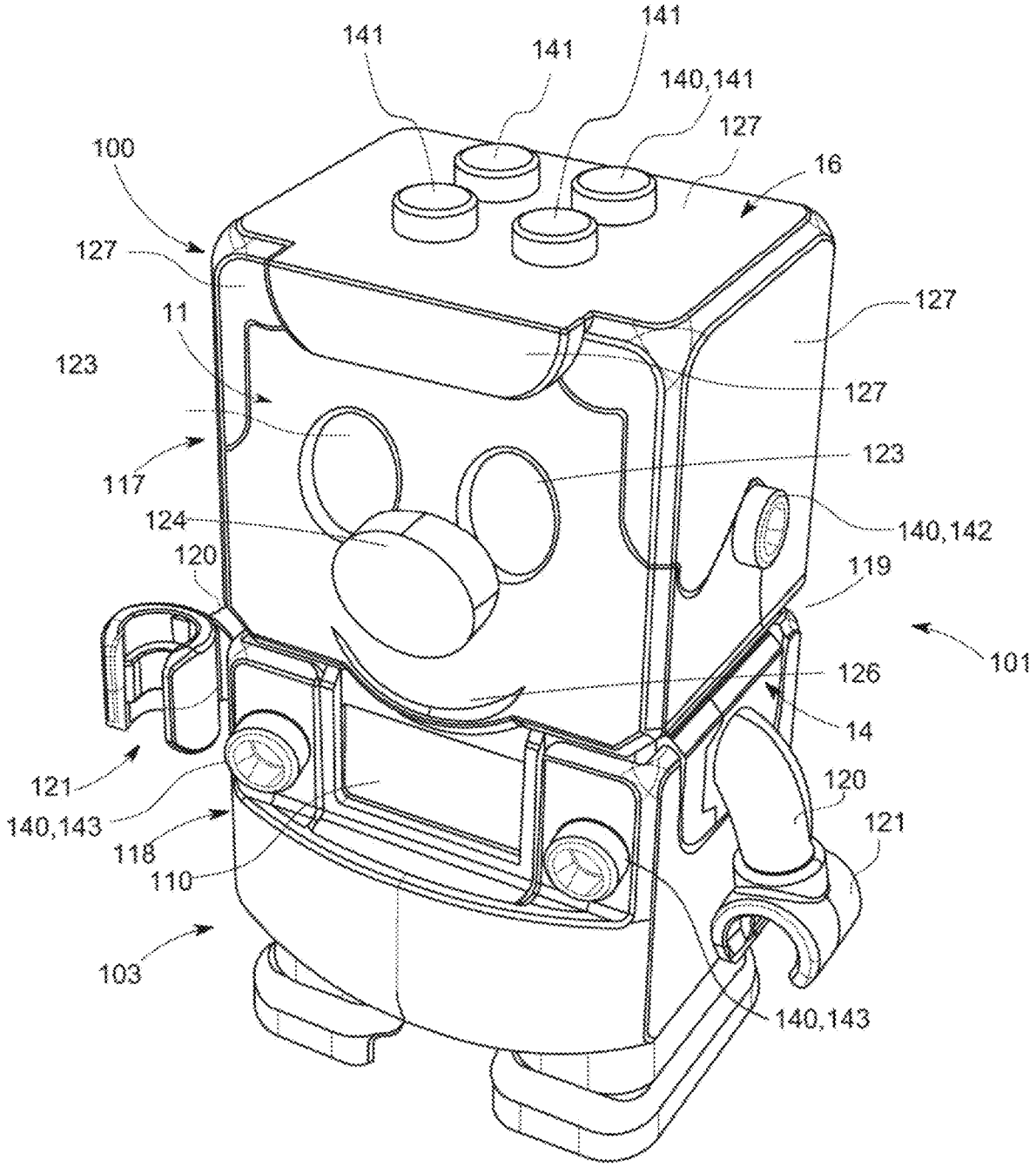
FIG. 1A, in a perspective view, shows an electronic device in the form of a toy figurine comprising a first part and a second part, and where the first part has a battery compartment and buttons according to an aspect of the disclosure.

The subject technology overcomes many of the prior art problems associated with toy figurines. The advantages, and other features of the technology disclosed herein, will become more readily apparent to those having ordinary skill in the art from the following detailed description of certain preferred embodiments taken in conjunction with the drawings which set forth representative embodiments of the present technology and wherein like reference numerals identify similar structural elements. Directional indications such as upward, downward, right, left and the like are used with respect to the figures and not meant in a limiting manner.

Figure 1B:
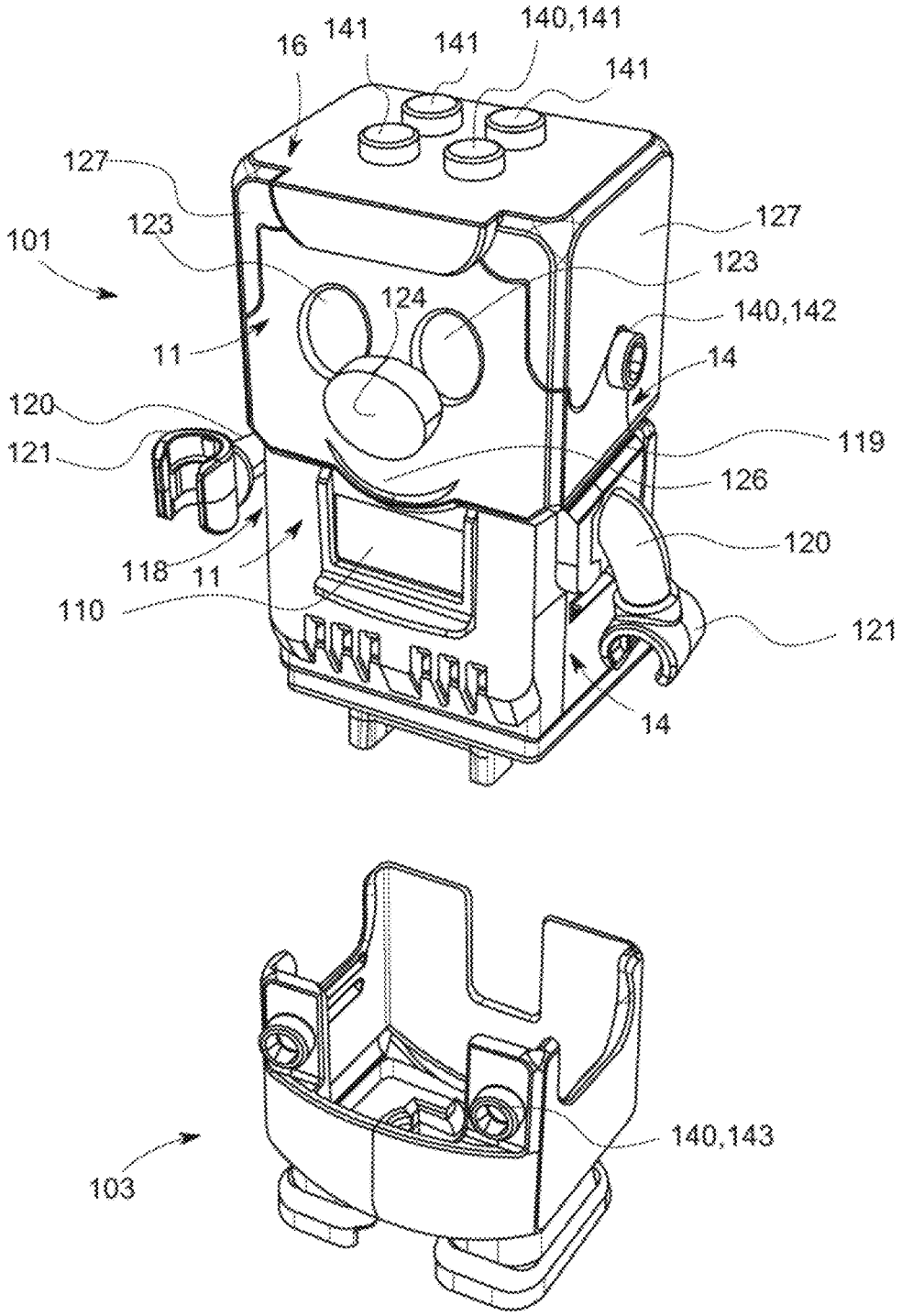
FIG. 1B, in a perspective view, shows the toy figurine of FIG. 1A where the first part and the second part are disassembled.
Figure 1C:
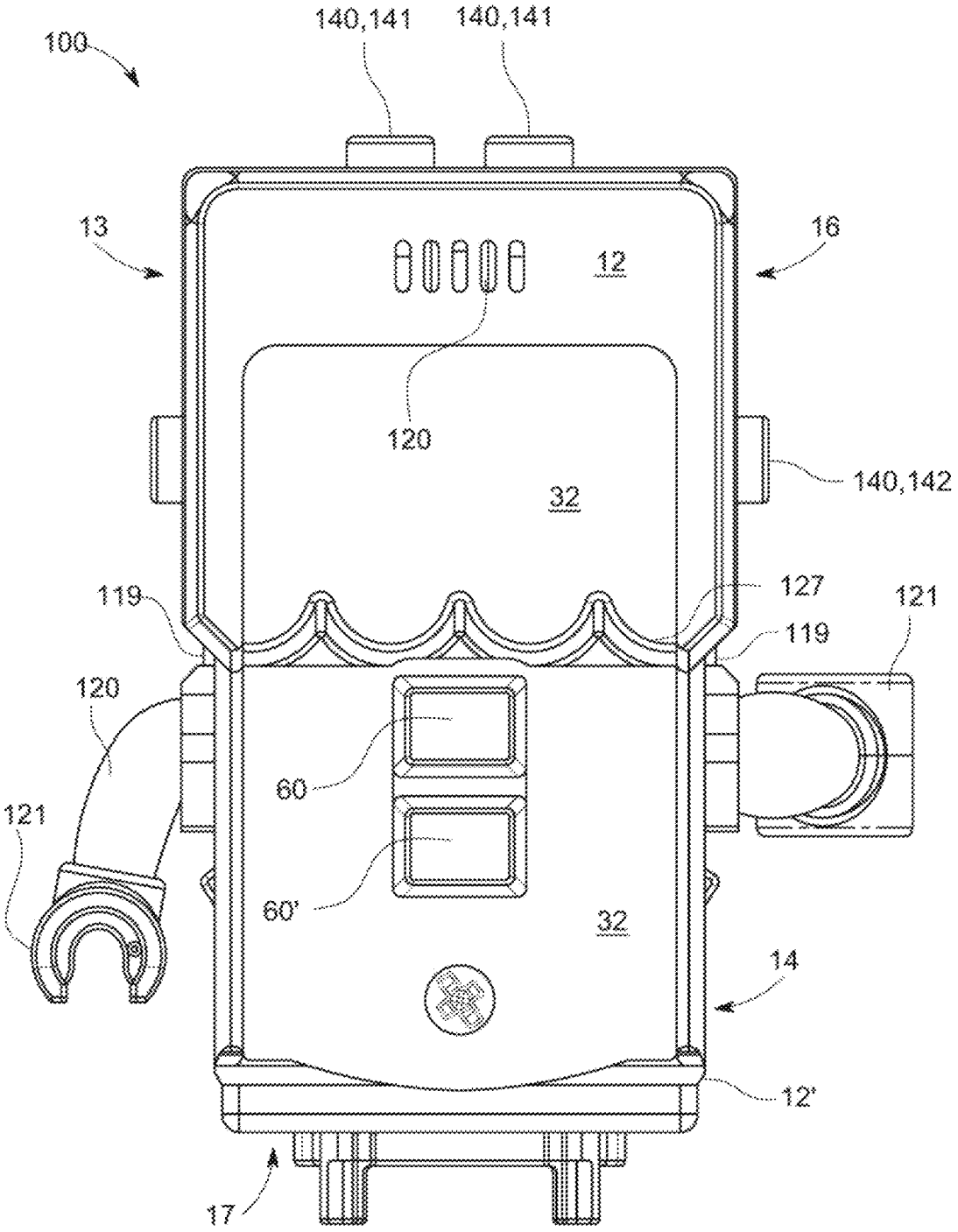
FIG. 1C shows the back side of the first part of the toy figurine of FIG. 1A.

FIGS. 1A-C, in a perspective view, show a two part toy figurine, or simply toy figurine 100, according to an aspect of the disclosure. The toy figurine 100 may comprise a toy figurine first part 101, and a toy figurine second part 103. The toy figurine first part 101 may also be referred to simply as first part 101. The toy figurine second part 103 may also be referred to simply as second part 103. The first part 101 and the second part 103 are configured to be releasably connected to each other to form the toy figurine 100, which in FIG. 1 is shown in an assembled state, where the first part 101 and the second part 103 are connected to each other. The first part 101 and the second part 103 may be connected via suitable, cooperating connection/coupling means 145.

As shown, the toy figurine 100 is of a type resembling a character such as human being, a toy human being. The character may alternatively be an animal, a toy animal, a fantasy creature, or the like.

Further, the toy figurine 100 is of a type comprising electronic components configured to enhance character traits relating to the character, which the toy figurine 100 is made to resemble. Such character traits may be represented by sounds, music, tactile e.g. vibration patterns, and light such as flashing lights etc.

For this purpose the toy figurine 100 is equipped with one or more electronic output components, such as one or more loud speaker, one or vibration devices, one or more light sources (such as LED), etc. For example, in an embodiment, and as shown in the FIGS. 1 and 2, the toy figurine 100 may comprise a digital screen/display 110. In embodiments, the electronic output components may be provided in the first part 101.

The toy figurine 100 may further be equipped with a suitable electronic controller (a processor), which is not shown in FIGS. 1A-C, and electronically connected with the one or more electronic components for controlling the same, e.g. via a suitable wiring (not shown). In some embodiments the electronic controller may be provided in the first part 101.

Figures 3A, 3B, 3C:
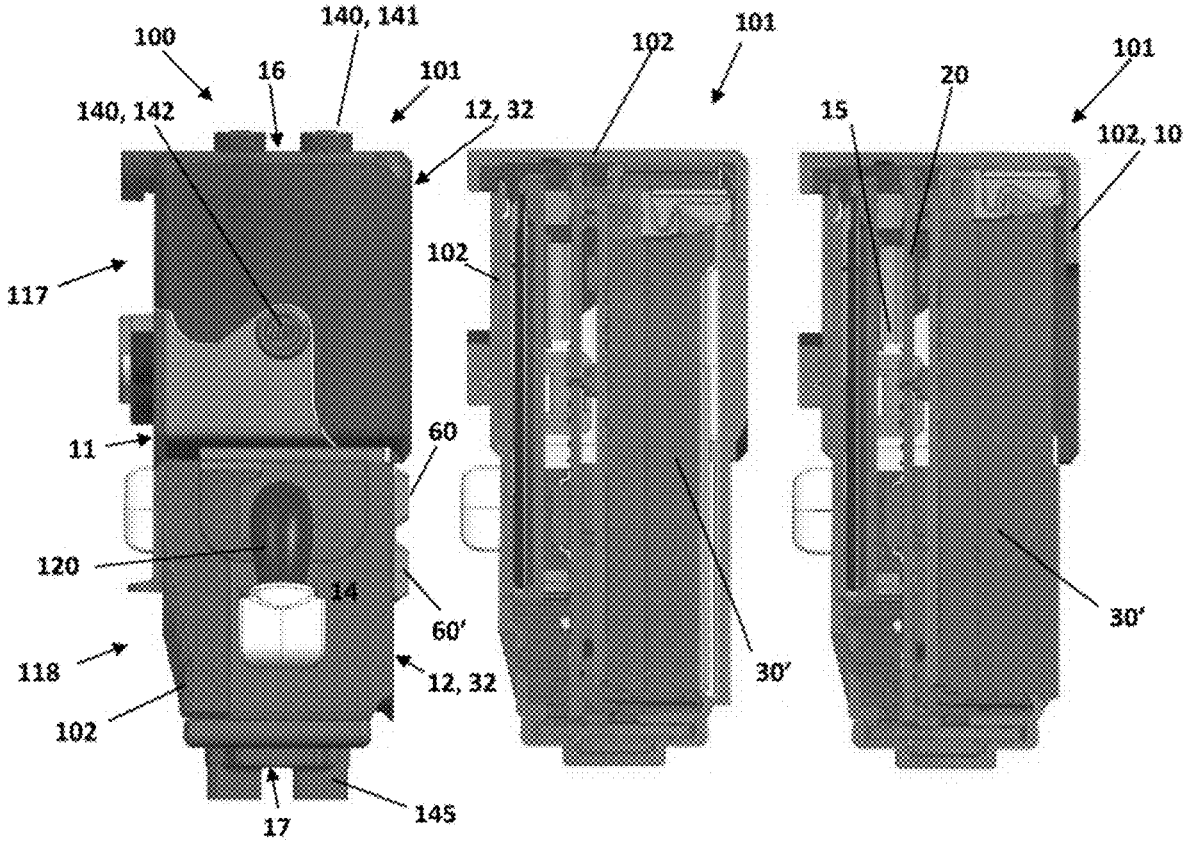
FIG. 3A, in a side view, shows a first part of the toy figurine of FIG. 1 and showing buttons arranged in a back wall of the toy figurine.
FIG. 3B shows a vertical section through the toy figurine portion of FIG. 3A, thereby showing an internal space and a battery compartment of the toy figurine first part.
FIG. 3C shows a section through the toy figurine first part of FIG. 3A, thereby showing an internal space and a battery compartment of the toy figurine first part.

The controller may for example be arranged on or from part of a circuit board 20 arranged inside the first part 101, see e.g. FIGS. 3B-C, or the controller may be electronically connected to such a circuit board.

Further, the toy figurine 100 may be equipped with one or more sensors (not shown), such as proximity sensors, vibration sensors, location sensors, sensors for detecting movement of the figurine, readers for detecting markers in a proximity of the toy figurine 100, cameras, etc. The one or more sensors may be connected to the electronic controller via suitable electrical connections, such as wiring (not shown). In some embodiments, one or more such sensors may be provided in the first part 101.

In an embodiment, the above mentioned digital screen/display 110 may be a touch screen, and be configured for both providing an output and for receiving an input from a user.

Further, the toy figurine 100 may comprise one or more (not shown) communication devices for communicating with other entities such as other similar toy figurines, computers, cell phones, etc. Such communication devices may comprise ports and/or wireless communication devices, such as blue tooth, Wi-Fi, etc. The one or more communication devices may be electronically connected to—and controlled by—the above mentioned electronic controller, via suitable electrical connections, such as wiring (not shown). In some embodiments, one or more such communication devices are provided in the first part 101.

Further, the toy figurine 100 may comprise a power source (not shown in FIG. 1, see FIGS. 3-7), such as one or more electric batteries 40. The power source is configured for powering the one or more electronic output components, the one or more sensors, the one more communication devices and/or the electronic controller. For this purpose, the one or more batteries is/are connected via suitable electronic circuitry, such as wiring. In preferred embodiments the power source is provided in the first part 101.

FIGS. 3A-C shows a first part 101 of a toy figurine 100, seen from the side. FIG. 3A shows a side view of the first part 101. FIGS. 3B-C shows sectional side views (vertical section) of the first part 101.

The first part 101 of the toy figurine 100 comprises a main portion or housing 10, 102, see e.g. FIGS. 3A-C. The housing 10, 102 of the first part 101 of the first toy figurine 100 may be essentially box shaped, as shown in e.g. FIGS. 1-3. The housing 10, 102 comprises a battery compart 30 enclosed in the housing 10, 102, see FIGS. 3B, 3C. The battery compartment is configured for holding two or more batteries 40, such as cylindrical, standard type consumer batteries. The housing 10, 102 may further enclose at least a subset of the above mentioned electronic components. Some electronic components, such as various sensors or a digital display may be arranged on outer surfaces or through outer walls of the housing 10, 102.

The first part 101 of the toy figurine 100 may comprise a first/upper portion resembling a head 117 of the character, and a second/lower portion resembling a body, such as an upper body 118 of the character which the toy figurine 100 is intended to look like/represent.

The first/upper portion resembling a head 117 and the second/lower portion 118 resembling a (upper) body may be visually distinguishable at least by a circumferential indentation 119 surrounding the housing 10, 102, and resembling a neck of the character which the toy figurine 100 is intended to look like/represent.

The box shape of the housing 10, 102 of the toy figurine first part 101 comprises a front surface, a back or rear surface parallel with and opposing the front surface, and two parallel and opposed side surfaces connected to the front surface and the back surface, and perpendicularly thereto. At the upper end, the front surface, the back or rear surface, and the side surfaces are connected to the upper surface, and at the lower end, the front surface, the back or rear surface, and the side surfaces are connected to the lower/bottom surface to form the essentially box shaped housing 102. The front surface is provided by a first outer wall 11. The back surface is provided by a second outer wall 12. The sides of the housing 10 are provided on a first side wall 13 and a second side wall 14. The upper surface is provided on a top wall 16. The lower surface is provided on a bottom wall 17. The walls enclose an internal space 15 of the toy figurine 100 first part.

The second outer surface 12, or at least portions thereof may be detachable, like a hatch or cover, provided as e.g. a lid 32 of the housing 10, 102 to provide access to the battery compartment 30 in order to allow replacement the two or more power sources (batteries 40).

To make the appearance of a specific character, the housing 10, 102 may be provided with ornamentations representative of certain characteristic features of the character, which the toy figurine 100 is supposed to resemble. The ornamentation may be provided e.g. by a colouring, and reliefs formed integrated with the outer walls 11, 12, 13, 14 16, 17, of the housing 10, 102 or parts thereof, or a combination thereof.

As shown in FIGS. 1 and 3A-C such ornamentations may comprise a set of eyes 123, a nose 124, a mouth 126 and hair 127. In the embodiment shown in FIGS. 1 and 3A-C, the mentioned features are shown as being formed as reliefs in the housing 102. For example, relief resembling hair 127 is formed on the top surface 16, the upper part of the side surfaces 13, 14, the upper part of the front surface 11, and the upper part of the back surface 12.

Figure 2:
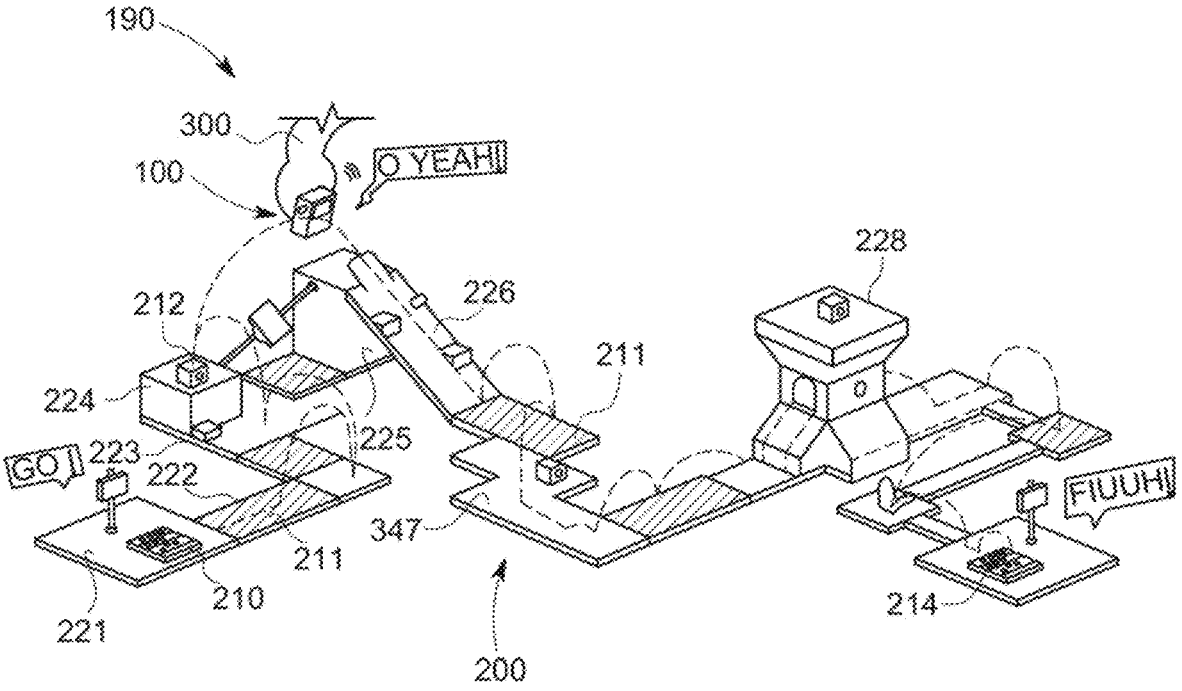
FIG. 2, in a perspective view, shows a play environment and a toy figurine e.g.

In the embodiment shown in FIG. 2, facial traits of a character, like mouth and eyes are indicated as being represented on a digital screen formed at the outer surface of the front surface of the toy figurine 100.

The toy figurine first part 101 may be provided with an arm 120 extending from each of the two side surfaces, i.e. from the side walls 13, 14. The arms 120 may be rotationally connected to the housing 10, 102. Further, each of the arms 120 may be provided with a hand 121. The hand 121 may be rotationally connected to the arm 120.

The hand 121 may as shown be formed as claw, with two flanges formed encircling a cylindrical space. The claw formed by the two flanges of the hand 121 thereby may form a connector configured for connecting to other construction toy parts (not shown) having at least portions that are cylindrical and dimensioned to cooperate with the connector by resilience of the two flanges of the claw forming the hand 121.

At the lower/bottom surface of the housing 10, 102, the first part 101 may be provided with first connection/coupling means 145 extending from the bottom wall 17, the first coupling means 145 being configured for cooperating with second connection/coupling means (not shown), formed in the toy figurine second part 103.

As shown in FIG. 1, the toy figurine first part 101 may be provided fifth connectors/connection means/coupling means 140, such as in the form of knobs 141, 142, 143. As shown in FIG. 1 there may, for example, be formed four knobs 141 on the upper/top surface of the top wall 16 of the housing 10, 102 and protruding therefrom. As shown, the four knobs may be arranged in a 2×2 array.

Thereby, the fifth coupling means/knobs 140, 141 may be used for connecting/coupling the first toy figurine part 101 to another toy construction element (not shown). For this purpose, the other toy construction element may be provided with sixth connection means/coupling means (not shown), for example in the form of corresponding/cooperating indentations configured for cooperating with the knobs 140, 141, 142, 143 as is known in the art of toy building/construction sets.

Each of the side surfaces of the first part 101 may be provided with one or more fifth connection/coupling means 140, 141, 142, 143. Further, the front surface of the second part 103 of the toy figurine 100 may be provided with one or more fifth connection/coupling means 140, 143. The one or more fifth connection/coupling means 140, 142, 143 e.g. in the form of knobs, may be used to connect other toy construction elements having sixth connection/coupling means as suggested above.

FIG. 2 illustrates an example of a toy system 190 comprising a physical play environment 200 constructed from toy construction elements 221, 222, 223, 224, 225, 226, 227, 228. The toy system 190 further comprises a toy figurine 100, which a user 300 can move about in the physical play environment 200. The toy figurine 100 may be the toy figurine 100 as described above, and having a battery compartment 20 and a button system 5 as described below. The toy figurine 100 may further comprise an accelerometer (not shown) for detecting movements of the toy figurine 100 and an optical reader (not shown) configured to detect different types of markers, 210, 211, 212, 214: One type of marker 212 may include a visible code, such as a microdot pattern, a QR code or the like: while other markers 211 may be colored tiles or other colored toy construction elements 200. However, it will be appreciated that other types of markers, such as visible markers, RFID markers, etc., may be used. The toy figurine 100 resembles a character. In this example, the reader (not shown) is facing downwards, i.e. configured to detect markers onto or above which the toy figurine 100 is placed.

The user 300 may initiate a play activity by holding the toy figurine 100 in contact or close proximity to a start marker 210. Responsive to detecting the start marker 210, the toy figurine 100 may enters an active play mode. In some embodiments, the toy system 1 includes different start markers 210, each indicative of a respective play activity. Alternatively or additionally, different play activities may be selected based on other criteria, e.g. a user input to the toy, communication with another toy figurine or with a processing device, based on previously completed play experiences, a progression level of the toy figurine, etc. A progression level may e.g. be stored by the toy figurine 100 and/or by a remote processing device (not shown) with which the toy figurine 100 is communicatively connected.

While in the active play state, the toy figurine 100 detects movements of the toy figurine 100 and it detects one or more markers 211, 212, for example, toy construction elements having predetermined color(s) or other visual markers, when the toy figurine 5 is brought in proximity of said markers.

When the toy detects a finish marker 214, the toy exits the active play state and may compute a score which depends on the movements and markers that have been detected while the toy was in the active play state.

The above described toy figurine 100 is an example of an electronic device according to the disclosure. It is clear from the above description that the outer walls or surfaces of the toy figurine 100 may be heavily occupied with ornamental traits and/or structures, coupling means and electronic components such as microphones, loudspeakers, digital displays 110, various sensors, cameras and the like. This may leave very little space on the external surfaces for placement of buttons, such as buttons for turning on and off power, and/or buttons for activing selected electronic features of the electronic device 1, such as a toy figurine 100.

The lack of space for such buttons 60, 60', 69 may be further be enhanced the electronic device 1 being small, for example being small relative to the battery compartment. For applications, such as the above described toy figurine 100, which may be operated by a child, it may—for reasons such as security—be particularly beneficial that the battery or batteries of the electronic device is/are a standard consumer type batteries. For example, the batteries 40 may be a standard size single cell cylindrical dry battery, such as A, AA, or AAA type standard batteries. AA type batteries are also known as double A, penlight or mignon batteries. The IEC 60086 system calls the AA size R6 and the ANSI C18 names it size 15. A zinc-carbon battery in size AAA is designated by IEC as "R03", an alkaline LR03, and by ANSI C18.1 as "24". In connection with the toy figurine 100 two size AAA batteries are preferably housed in the battery compartment 30.

This causes a volume of the battery compartment 30 of the electronic device 1 of the toy figurine 100 to take up a large proportion of a total volume of the housing 10, 102 of the electronic device 1.

The present disclosure is particularly useful in connection with electronic devices 1, where the battery compartment 30 take up a large proportion of the total volume of the housing 10, 102 of the electronic device 1. For the purpose of this application a large proportion is when a volume of the battery compartment 30 is larger than 30% of a total volume of the housing 10, 102.

Figure 4:
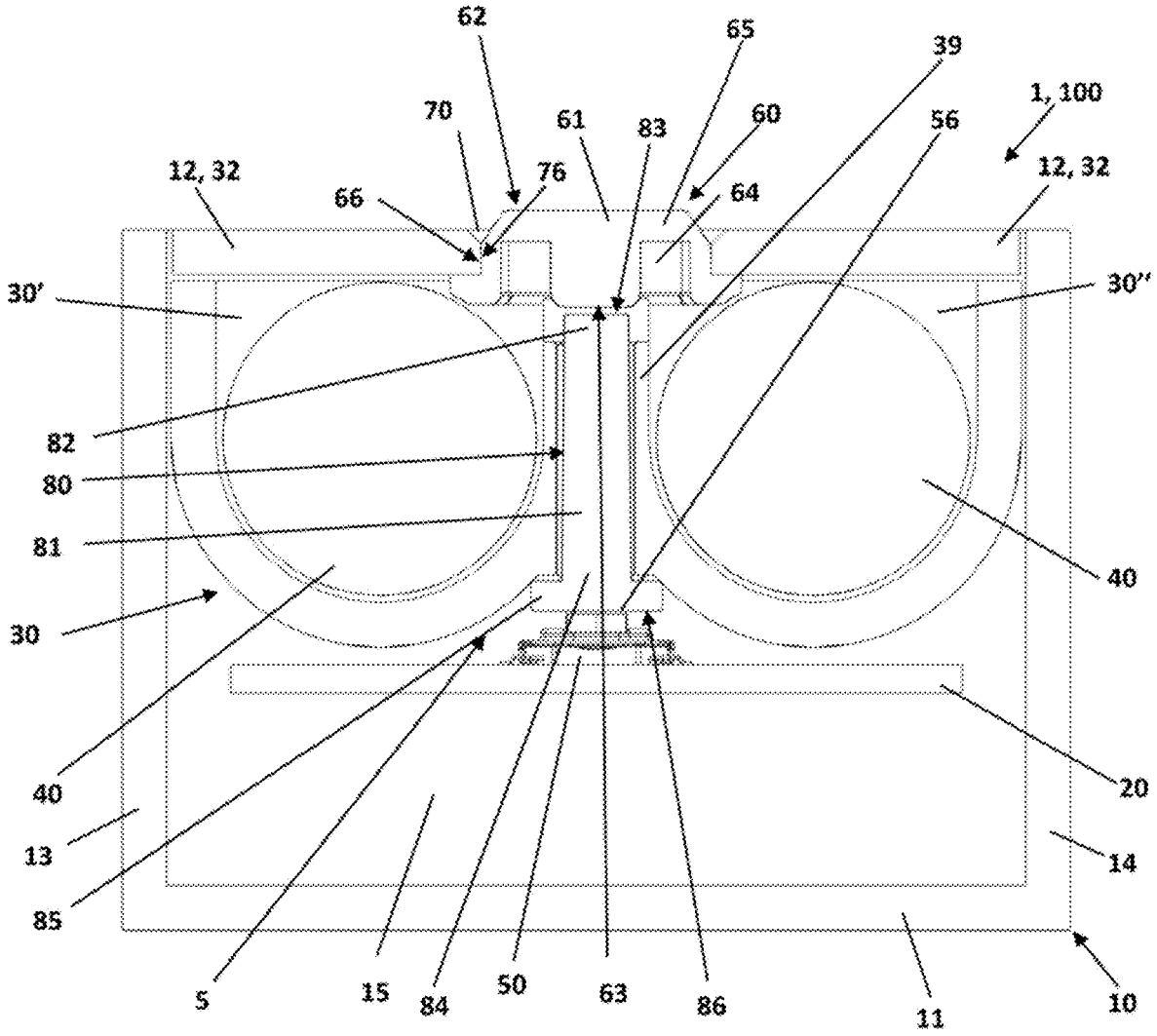
FIG. 4, in a horizontal section shows a housing of an electronic device, such as the toy figurine of FIG. 1 and showing an internal space of the housing, with a circuit board and a battery compartment, and a button system.
Figure 5:
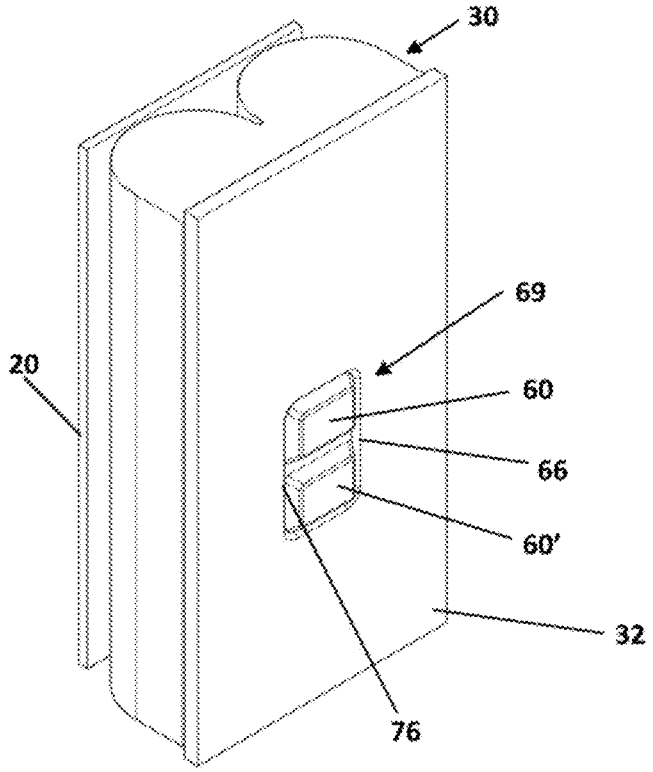
FIG. 5, in a perspective view, shows a circuit board, a battery compartment covered by a lid and a button system provided in the lid.

Turning now to FIG. 4, an electrical device 1 according to the disclosure may more generally comprise a housing 10.

The housing 10 comprises at least one first outer wall 11 and a second outer wall 12 and an internal space 15 there between. As shown in FIG. 4 the housing further comprises a first sidewall 13 and a second sidewall 14. The figure illustrates a section through the housing, so only the four mentioned walls are shown. However, the housing may further comprise a top wall 16 and a bottom wall 17 as indicated in e.g. FIGS. 1 and 3.

The first outer wall 11 may preferably be a front wall of the electronic device 1. Likewise, the second outer wall 12 may preferably be a back wall of the electronic device 1.

A circuit board 20, such as a printed circuit board (PCB) may be provided in the internal space 15 of the housing 10. The housing 10 may further be provided with one or more electrical components, such as those described above for the toy figurine 100 and arranged on the circuit board and/or in the internal space 15 and/or on or through the walls 11, 12, 13, 14, 16, 17 of the housing 10.

The electrical device 1 further comprises a battery compartment 30 configured for receiving two or more elongate batteries 40.

The battery compartment 30 is provided in or adjacent to said internal space 15 of the housing 10. As shown in FIG. 4 the battery compartment 30 may be an entity provided inside the internal space of the housing 10 of the electronic device 1.

However, in some (not shown) embodiments, parts—such as walls, supports etc.—are formed as integral with the housing 10, for example in plastic and in an injection moulding process. In further (not shown) embodiments, the battery compartment 30 may be a separate entity or unit, which is attachable to/detachable from the first part 101 of the toy figurine 100 forming an electronic device 1. In any case, at least a lid 32 for providing access to the battery compartment 30, and forming at least part of one outer surface, such as the second outer wall 12, of the first part 101 of the toy figurine 100 is attachable to/detachable from the first part 101 of the toy figurine 100.

In either case, the battery compartment 30 comprises a first battery space 30' and a second battery space 30". The first battery space 30' and the second battery space 30" are each configured for receiving an elongate battery 40, see e.g. FIG. 6. This means that a length a width and depth of the first and second battery spaces 30', 30" are adapted to the size (length and diameter) of the batteries intended for use, and to allow room for electrical connectors 45, 46, see e.g. FIG. 7, such as spring connectors, configured for providing an electrical contact between each of the batteries and the circuit board, and some or all the electronic components of the electronic device 1, for example as mentioned above.

The battery compartment 30 further comprises a lid 32 covering said first and second battery spaces 30', 30". In the embodiment shown in FIG. 4, the lid 32 is detachable from the battery compartment 30 or the housing 10, or e.g. pivotally attached to the battery compartment 30 or the housing, and thereby functions as a hatch or cover, to allow user access to the battery compartment 30, such that batteries inserted therein may be replaced. The lid 32 may coincide with a portion of the second wall 12 (such as the back wall) of the first part 101 of the toy figurine 100 configured as an electronic device 1, or form the entire second outer wall.

Also visible in FIG. 4 is a first electrical switch 50. Generally, the first electrical switch 50 is provided in the inner space 15 of the housing 10 in a position across from said lid 32 relative to the battery compartment 30. The first electrical switch 50 is electronically connected to said circuit board 20.

In the embodiment shown in FIG. 4, the first electrical switch 50 is attached to the circuit board 20. The circuit board 20 in this embodiment is further positioned in parallel with the lid 32 of the battery compartment 30.

It will however be appreciated that in other not shown embodiments the first electrical switch 50 may instead be positioned on the internal surface of the opposed first outer wall 11, or on a support structure, a flange for example, extending from the opposed first outer wall 11 or from an inner surface of one of the first or second side walls 13, 14. In such embodiments, the circuit board 20 may be positioned in other ways than in parallel with the lid 32 of the battery compartment 30.

In either case, and as also mentioned above, the first electrical switch 50 is connected electronically to the circuit board 20. The first electrical switch 50 is configured for activating a functionality of the circuit board or a component electrically connected thereto, or the first electrical switch 50 may be configured for turning the power from the batteries 40 connected in the battery compartment 30 on and off.

The first electrical switch 50 may be a micro switch. The first electrical switch 50 is activated/deactivated by pushing down on a contact surface 56 provided on to the first electrical switch 50. As the first electrical switch 50 is located inside the internal space 15 of the housing 10 of the electronic device 1, it is difficult for a user to access the first electrical switch 50.

For this purpose, a first push button 60 is provided in the lid 32 and located opposite to the first electrical switch 50, relative to the battery compartment 30.

The first push button 60 has an inner contact surface 63, i.e. a contact surface facing into the battery compartment and a second contact surface, upper contact surface 62, facing away from the battery compartment 30, and which is configured for user contact, i.e. it is operable by a user's finger. Various embodiments of the first push button are described further below.

However, as shown in FIG. 4, a first push pin 80 is provided between the first electrical switch 50 and the first push button 60. The first push pin 80 is preferably an elongate structure having an elongate body 81. The elongate body 81 has a first end 82 and a second end 82. At the first end 82 of the first push pin 80, a first contact surface 83 is provided. The first contact surface 83 of the first push pin 80 is arranged to abut on the inner contact surface 63 of the first push button 60. At the second end 82 of the first push pin 80, a second contact surface 86 is provided. The second contact surface 86 of the first push pin 80 is arranged to abut on the first contact surface 56 of the first electronic switch 50.

The first push pin 80 is slideably arranged in a first pin guide 90 provided between the first battery space 30' and the second battery space 30" of the battery compartment 30. Thereby, the first electrical switch 50 may be activated by pushing the first push button 60.

Figure 6:
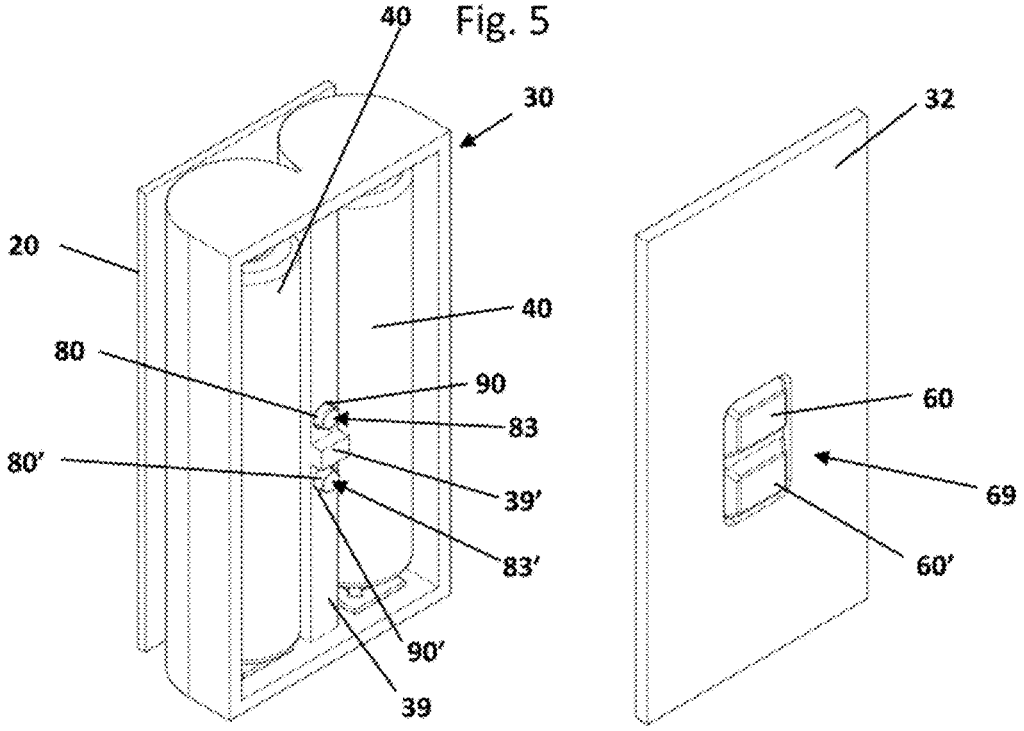
FIG. 6, in a perspective view shows the shows circuit board, battery compartment, lid and button system of FIG. 6, but with the lid with a button unit of the button system removed from the battery compartment.

As shown in FIG. 6, the first pin guide 90 may be arranged as a though-hole through a dividing wall 39 separating the first battery space 30' from the second battery space 30".

Thus, in some embodiments, the battery compartment may comprise a dividing wall 39 separating the first battery space 30' from the second battery space 30". In such cases advantageously, the first pin guide 90 may be formed there through as mentioned.

However, in (not shown) embodiments, the first pin guide 90 may be formed as structure, such as a flange, extending from another inner surface of the housing 10.

In some embodiments, the first push button 60 may be formed in a flexible material. For example the first push button 60 may be formed in a soft polymer material, such as rubber or a soft plastic.

In some embodiments (not shown) the first push button 60 may be formed integral with the lid 32 e.g. as a flexible portion of the lid 32.

However, as shown in FIG. 4, the first push button 60 is provided through an opening 70 in the lid 32 of the battery compartment 30.

However, in a preferred embodiment, the push button 60 is formed in a flexible material and comprises a rim 66, which is configured to be attachable to the rim of the opening 76, As shown, the push button 60 may have a peripheral flange, extending under the rim of the opening 76. The first push button 60 may be held in place by the first push pin 80. However, in some embodiments, the rim 66 of the first push button 60 may further be glued or welded to the rim of the opening 76.

The first push button 60 may—as shown in FIG. 4—comprise a button body 61, on which the upper contact surface 62 is formed on the external side thereof, and on which the inner contact surface (63 is formed on an internal side thereof. The button body 61 has one portion of a first thickness surrounded by a circumferential (such as circular) portion 65, where the circumferential portion has a reduced thickness. Thereby, as flexibility may be provided by the soft material in which the first pushbutton is formed 60. This allows the button body with the inner contact surface 63 to be depressed relative to the rim 66 of the first push button 60, and thereby to push the push pin towards the first electrical switch 50 to thereby activate it.

Although, the disclosure has been described above in connection with a single (first) electrical switch 50 in combination with a single (first) push pin 80 and a single (first) push button 60, as shown in FIG. 3A and FIGS. 5-8, in some embodiment, the electronic device may comprise two or more sets of electrical switches, push pins push buttons.

Thus in one embodiment, the electronic device according comprises a second electrical switch 50', which is provided in the inner space 15 of the housing 10 and across from said lid 32, and which is electronically connected to said circuit board 20. In this embodiment, the electronic device 1 further comprises a second push button 60', which is provided in the lid 32, and located opposite the second electrical switch 50' relative to the battery compartment 30. In this embodiment, the electronic device 1 further comprises a second push pin 80', which is slideably arranged in a second pin guide 90', which second pin guide 90' is provided between the first battery space 30' and the second battery space 30". The second push pin 80' is elongate and comprises a first contact surface 83' at an outer end 82' of the second push pin 80', and a second contact surface 86' at an inner end 84' of the second push pin 80'. The first contact surface 83 of the second push pin 80' abuts on an inner contact surface 63' of the second push button 60', and the second contact surface 86' of the second push pin 80' abuts on the second electrical switch 50'.

The second electrical switch 50' may be identical to the first electrical switch 50, although it may preferably activate a different functionality of the electronic device 1. Further, the second electrical switch 50' may be arranged in the same way as the first electrical switch 50, described above.

Further, the second push button 60' may be identical to the first push button 60, and may be arranged in any of the ways the first push button 60 is arranged, as described above.

Further, the second push pin 80' may be identical to the first push pin 80 described above. Also, the second push pin 80' may be arranged in the housing 10 in any of the ways described for the first push pin 80 above. As shown in FIG. 6, both a first push pin 80 and a second push pin 80' are guided by individual through-holes through a dividing wall 39 as described above, whereby the through-holes through the dividing wall 39 form a first pin guide 90 and a second pin guide 90'.

As indicated, the first push button 60 and the second push button 60' may—in not shown embodiments—be arranged in individual openings 70 of the lid 32 of the battery compartment 30.

Figure 7:
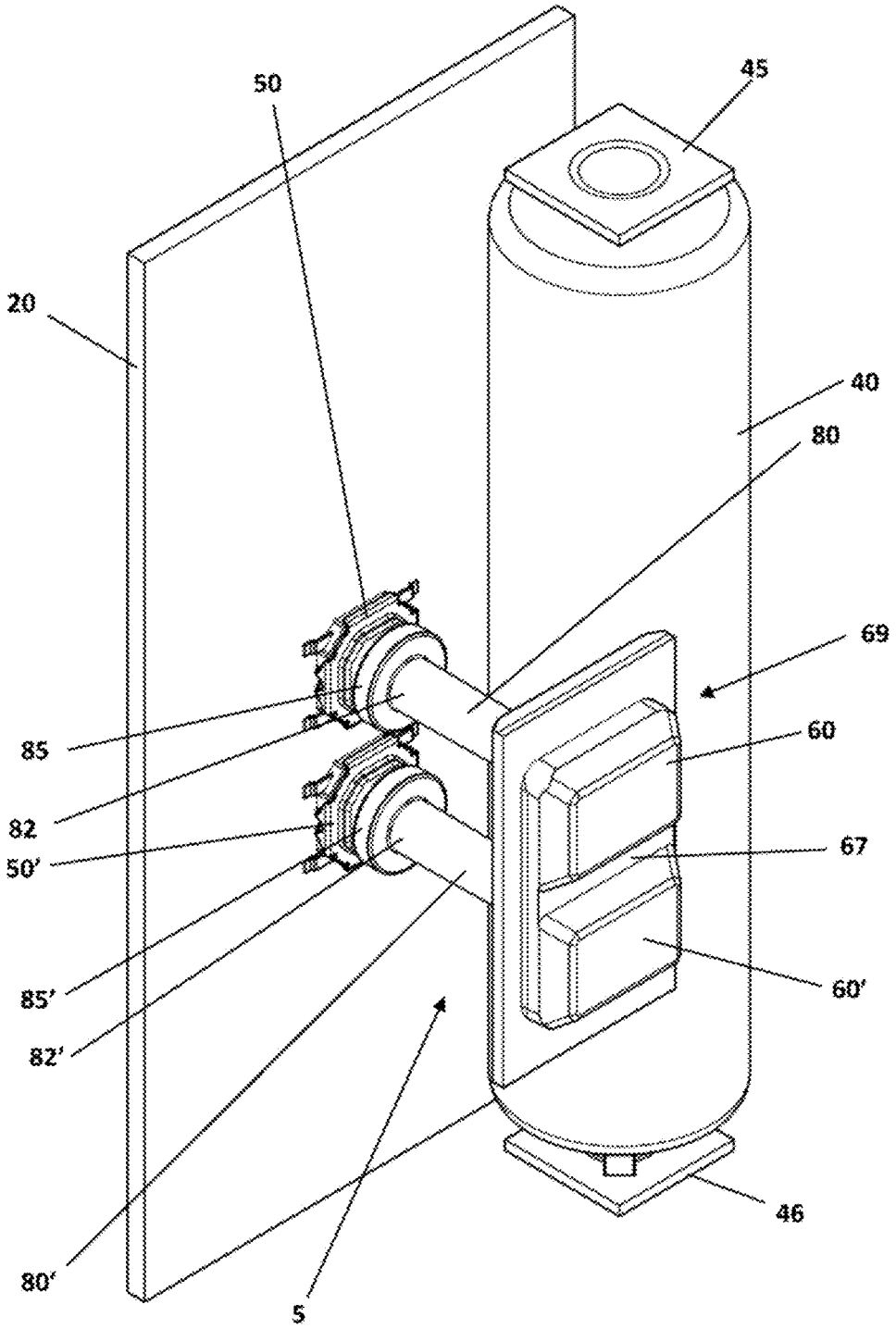
FIG. 7, in a perspective view, shows a circuit board, a battery, and a button system provided.
Figure 8:
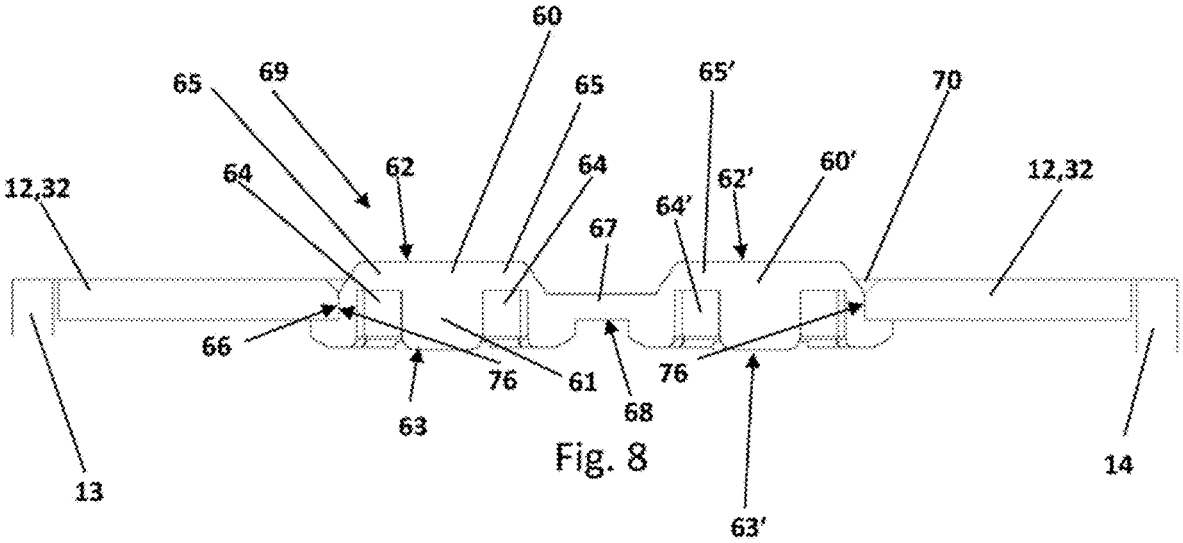
FIG. 8, in vertical section, shows a portion of an electric device with a lid and a button unit comprising a first push button and a second push button.

However, in a preferred embodiment, and as shown in FIGS. 7 and 8, the first push button 60, and the second push button 60' are formed integrated as one push button unit 69.

In principle, the push button unit 69 may be formed in a rigid material. In such embodiment the push button unit could be pivotally arranged around a central portion of the push button unit 69.

However, preferably the push button unit 69 is formed in a resilient material (or soft material), such as described above.

In this case, the first push button 60 and the second push button 60' may be formed as basically as described above, but connected by a connection flange 67, wherein an indention 68 is formed in the connection flange 67. The indention 68 in the connection flange 67 prevents or reduces transfer of forces from the first push button 60 to the second push button 60' (or vice versa) when one of the first push button 60 and the second push button 60' is pushed. The indention 68 may be formed in the surface of the connection flange 67 facing towards the battery compartment 30, or in the surface of the connection flange 67 facing away from the battery compartment 30.

However, preferably the indention 68 is formed in the surface of the connection flange 67 facing towards the battery compartment 30, such that the indentation 68 may cooperate with a button divider 39' formed as a tap and extending from the dividing wall 39. The button divider 39' is preferably formed and sized to cooperate with the indention 68, such the button divider 39' is received on the indentation.

It is to be noted that the figures and the above description have shown the example embodiments in a simple and schematic manner. Many of the specific mechanical details have not been shown since the person skilled in the art should be familiar with these details and they would just unnecessarily complicate this description.

LIST OF PARTS

1 electronic device
5 button system
10 housing of electronic device
11 (first) outer wall of housing, front wall
12 (second) outer wall of housing, back wall
13 first side wall of housing
14 second side wall of housing
15 internal space of the housing
16 top wall
17 bottom wall
20 circuit board
30 battery compartment
30' first battery space, battery receiving space of the battery compartment
30" second battery space, battery receiving space of the battery compartment
32 lid of battery compartment
39 dividing wall between first battery space and second battery space
39' button divider
40 battery/electrical battery
45 electrical connector
46 electrical connector
50 first electrical switch
50' second electrical switch
56 contact surface of first electrical switch
56' contact surface of second electrical switch
60 first push button
60' second push button
61 body of first push button
61' body of second push button
62 outer contact surface of the first push button
62' outer contact surface of the second push button
63 inner contact surface of first push button
63' inner contact surface of second push button
64 inner opening forming a weakened portion of the body of the first push button
64' inner opening forming a weakened portion of the body of the second push button
65 circumferential portion
66 rim of first push button
67 connection flange between first push button and second push button
68 indention in connection flange
69 push button unit
70 opening through lid of battery compartment
76 rim of the opening in the lid
80 first push pin
80' second push pin
81 elongate body of first push pin
81' elongate body of second push pin
82 outer end of first push pin
82' outer end of second push pin
83 first contact surface, contact surface at outer end of first push pin
83' first contact surface, contact surface at outer end of second push pin
84 inner end of first push pin
84' inner end of second push pin
85 head at inner end of first push pin
85' head at inner end of second push pin
86 second contact surface, contact surface on head at inner end of first push pin
86' second contact surface, contact surface on head at inner end of second push pin
90 first pin guide
90' second pin guide
100 toy figurine
101 toy figurine first part
102 housing of toy figurine first part
103 toy figurine second part, connectable to toy figurine first part
110 digital screen
117 head
118 body
119 neck/circumferential indentation
120 arm
121 hand
123 eye
124 nose
126 mouth
127 hair relief
140 coupling means or connection means, knobs
141 knobs
142 knobs
143 knobs
145 first connection/coupling means
190 toy system
200 physical play environment
210 start marker
211 one type of marker
212 another type of marker
213 marker
214 end marker
221, 222, 223, 224, 225, 226, 227, 228 toy construction elements of a physical play environment physical play environment
300 user.

The invention claimed is:

1. A toy figurine comprising:

a housing having:

a first outer wall, a second outer wall, a first side wall, a second side wall, a top wall, a bottom wall, and an internal space formed within the walls, and the first side wall and the second side wall each comprising an arm, ornamentations, and connectors, a circuit board provided in the internal space of the housing; and a battery compartment formed within the housing and having a first battery space and a second battery space configured for receiving elongate batteries, the battery compartment provided adjacent to the internal space of the housing, at least a portion of the second outer wall being formed as a lid of the battery compartment, wherein:

a first electrical switch is provided in the internal space of the housing across from the lid and electronically connected to the circuit board, a first push button is provided in the lid opposite the first electrical switch, a first push pin, formed separately from the first push button, is slideably arranged in a first pin guide provided between the first battery space and the second battery space, the first push pin is elongate and comprises a first contact surface at an outer end and a second contact surface at an inner end of the first push pin, and the first contact surface of the first push pin abuts on an inner contact surface of the first push button, and the second contact surface of the first push pin abuts on the first electrical switch.

2. The toy figurine according to claim 1, wherein the surface area of an external surface of the push button is at least twice as large as the area of first contact surface of the first push pin.

3. The toy figurine according to the claim 1, wherein the surface area of an external surface of the push button is at least 7% of the surface area of the surface in which the lid is formed.

4. The toy figurine according to claim 1, wherein the circuit board is provided in parallel with the lid of the battery compartment, and opposite to the lid relative to the internal spaces, and wherein the first electrical switch is attached to the circuit board.

5. The toy figurine according to claim 1, wherein the first push button comprises a button body on which the upper contact surface formed on the external side thereof and wherein the inner contact surface is formed on an internal side thereof, and wherein in the button body has one portion of a first thickness surrounded by a circumferential portion of a reduced thickness.

6. The toy figurine according to claim 1, wherein the first push button is provided through an opening in the lid, and where the push button comprises a rim attached to a rim of the opening.

7. The toy figurine according to claim 1, wherein the battery compartment comprises a dividing wall separating the first battery space from the second battery space, and wherein the first pin guide is formed in the dividing wall.

8. The toy figurine according to claim 1, wherein a second electrical switch is provided in the internal space of the housing across from the lid and electronically connected to the circuit board, wherein a second push button is provided in the lid opposite the second electrical switch, wherein a second push pin is slideably arranged in a second pin guide provided between the first battery space and the second battery space, wherein the second push pin is elongate and comprises a first contact surface at an outer end and a second contact surface at an inner end of the second push pin, wherein the first contact surface of the second push pin abuts on an inner contact surface of the second push button, and the second contact surface of the second push pin abuts on the second electrical switch.

9. The toy figurine according to claim 8, wherein the first push button and the second push button are formed integrally as one push button unit.

10. The toy figurine according to claim 9, wherein the push button unit is formed in a resilient material, wherein the first push button and the second push button are connected by a connection flange, and wherein an indention is formed in the connection flange.

11. The toy figurine according to claim 10, wherein the battery compartment comprises a dividing wall separating the first battery space from the second battery space, wherein the first pin guide and the second pin guide are formed in the dividing wall, wherein a button divider extends from the dividing wall and is configured for cooperating with the indention formed in the connection flange.

12. The toy figurine according to claim 1, wherein a volume of the battery compartment is larger than 50% of a total volume of the housing.

13. The toy figurine according to claim 1, the first outer wall has a digital display connected to the circuit board, ornamentations, and connectors.

14. A toy figurine comprising:

a housing having a first outer wall, a second outer wall, a first side wall, a second side wall, a top wall, a bottom wall, and an internal space formed within the walls, the first side wall and the second side wall each comprising an arm, ornamentations, and connectors;

a circuit board mounted within the internal space; and a battery compartment formed within the housing, having a first battery space and a second battery space configured for receiving elongate batteries, at least a portion of the second outer wall being formed as a lid of the battery compartment, wherein:

a first electrical switch is provided in the internal space of the housing across from the lid and electronically connected to the circuit board, and a first push button is provided in the lid opposite the first electrical switch, a first push pin, formed separately from the first push button, is slideably arranged in a first pin guide provided between the first battery space and the second battery space.

15. The toy figurine according to claim 14, further comprising:

a second electrical switch is provided in the inner internal space of the housing across from the lid and electronically connected to the circuit board, a second push button is provided in the lid opposite the second electrical switch, a second push pin is slideably arranged in a second pin guide provided between the first battery space and the second battery space, wherein the second push pin is elongate and comprises a first contact surface at an outer end and a second contact surface at an inner end of the second push pin, wherein the first contact surface of the second push pin abuts on an inner contact surface of the second push button, and the second contact surface of the second push pin abuts the second electrical switch.

16. A toy figurine comprising:

a multi-part housing having a first outer wall, a second outer wall, a first side wall, a second side wall, a top wall, a bottom wall, and an inner space formed within the walls, the first side wall and the second side wall each comprising an arm, ornamentations, and connectors;

a circuit board provided in the inner space, the circuit board in electrical communication with an electrical switch for activating a functionality of the circuit board;

a battery compartment formed within the housing, having a first battery space and a second battery space configured for receiving elongate batteries, at least a portion of the second outer wall being formed as a lid of the battery compartment, wherein:

a first electrical switch is provided in the inner space of the housing across from the lid and electronically connected to the circuit board, and a first push button is provided in the lid opposite the first electrical switch, a first push pin, formed separately from the first push button, is slideably arranged in a first pin guide provided between the first battery space and the second battery space.

17. The toy figurine of claim 16, further comprising an accelerometer configured to detect movements of the toy figurine, wherein activating a functionality of the circuit board includes activating the accelerometer.

18. The toy figurine of claim 16, further comprising an optical reader configured to detect different types of markers in a play environment, wherein activating a functionality of the circuit board includes activating the optical reader.

19. The toy figurine of claim 16, further comprising:

a second electrical switch is provided in the inner space of the housing across from the lid and electronically connected to the circuit board, a second push button is provided in the lid opposite the second electrical switch, a second push pin is slideably arranged in a second pin guide provided between the first battery space and the second battery space, wherein the second push pin is elongate and comprises a first contact surface at an outer end and a second contact surface at an inner end of the second push pin, wherein the first contact surface of the second push pin abuts on an inner contact surface of the second push button, and the second contact surface of the second push pin abuts the second electrical switch.

* * * * *